United States Patent [19]

Rohner et al.

[11] 3,949,946

[45] Apr. 13, 1976

[54] APPARATUS FOR HOLDING READY AND POSITIONING OF YARN PACKAGES IN TEXTILE MACHINES

[75] Inventors: Joachim Rohner, Rheydt; Wilhelm Maassen, Monchen-Gladbach; Franz-Josef Reiners, Ratheim, all of Germany

[73] Assignee: W. Schlafhorst & Co., Monchen-Gladbach, Germany

[22] Filed: Apr. 17, 1972

[21] Appl. No.: 244,445

[30] Foreign Application Priority Data

Apr. 16, 1971 Germany ..... 2118443

[52] U.S. Cl. ..... 242/35.5 R; 242/35.6 R

[51] Int. Cl.[2] ..... B65H 54/20; B65H 54/26

[58] Field of Search ..... 242/35.6 R, 35.5 R, 35.5 A, 242/130

[56] References Cited

UNITED STATES PATENTS

| | | | |
|---|---|---|---|
| 1,978,550 | 10/1934 | Reiners et al. | 242/130 X |
| 2,010,465 | 8/1935 | Reiners et al. | 242/35.5 A |
| 2,208,930 | 7/1940 | Kahlisch | 242/35.6 R |
| 2,338,914 | 1/1944 | Esser et al. | 242/35.6 R |
| 2,350,927 | 6/1944 | Reiners et al. | 242/35.5 A |
| 2,632,612 | 3/1953 | Stange | 242/130 |
| 2,757,874 | 8/1956 | Marcellus | 242/35.6 R |
| 3,017,129 | 1/1962 | Trost | 242/35.6 R |

*Primary Examiner*—Stanley N. Gilreath
*Attorney, Agent, or Firm*—Herbert L. Lerner

[57] ABSTRACT

Apparatus for holding ready and positioning of yarn packages in textile machines which includes spool holders radially disposed in stellar form and revolvable about horizontally mounted shafts, and respective arm means to which the spool holders are articulatingly secured and together with which form an unwinding device.

8 Claims, 4 Drawing Figures

1
2
4
3
7
8
48
12
13
5
6
36
47
36'
26
F'
15
10
24'
32
19
30
23
27
21
22
24
23
9
44
34
29
31
16
35
F
18
28
34
11
14
19
38
21
37
39
21
43
42
19
33
42'
20
41
40
23
25
48
24''

F'
24'
32
47
19
31
26
47
1
35
28
16
43
34
F
23
45
43
33
46
21b
42
18
33
19
32
46
31
25
14
42'
17
23
21a
41
48
24''

APPARATUS FOR HOLDING READY AND POSITIONING OF YARN PACKAGES IN TEXTILE MACHINES

The invention relates to apparatus for holding ready and positioning of yarn packages in textile machines, particularly in automatic winding machines with spool holders disposed in star-like fashion and rotatable about horizontally mounted shafts.

Such devices have the objective of presenting the yarn packages intended for further processing to the work stations of textile machines in an appropriate unwinding position. By means of these devices, furthermore, an uninterrupted supply of thread to the individual work stations is provided if, in addition to the spools or yarn packages that are in unwinding position, addditional spools that are held ready in reserve and that are unwound are replaced by new ones.

From the Swiss Patent No. 236,915, a device of the aforedescribed type for a cross-winding or "cheese" winding machine has become known, and in German Patent No. 711,954 a similar device is disclosed in a winding machine with stationary winding stations. However, these and similar embodiments did not receive general acceptance in practice even then and are also not usable in the fully automatic winding machines which have been developed in the interim. The reason for this is that in order to supply yarn packages to the heretofore known spool holders, that are disposed radially in star-like fashion, complex and costly mechanical elements are required which, in the course of motion thereof produce a detrimental effect on the functional reliability of the devices. Further difficulties are presented in making ready the starting ends of the threads or yarns of the thread or yarn packages that are to be placed on the spool holders, as well as in meeting a particularly important requirement, which is to maintain completely separate the readied starting ends of the yarns while the yarn packages are shifted farther into the unwinding position as well as during unwinding operation proper. Keeping all of the threads separate during the entire course of the operation, without any difficulty, is not assured with devices of this type, both in automatic as well as in simpler manually operatd machines. These known devices are furthermore suited only for processing elongated yarn or thread packages, such as spinning or twisting cops, for example, where the space required for the large swinging radius of the cops has a disadvantageous effect on the servicing level and accessibility of the machine.

In order to utilize textile machines, particularly automatic winding machines, as universally as possible, it is necessary, however, to process other spool formats also, such as, cross-wound coils or cheeses or the like, of relatively large size or volume. This is not possible with the devices that have become known heretofore, particularly because of the rigidly disposed array of all the spool holders which take up yarn packages and the spatial problems resulting therefrom, as well as of the previously mentioned shortcomings with respect to the preparation of the starting ends of the yarns and the undisturbed guidance of the yarns.

It is accordingly an object of the invention to provide a universally usable positioning apparatus which avoids the shortcomings of the heretofore known apparatus of this general type and which, more specifically, requires a minimum of space and is suitable for yarn packages of different formats as well as for being loaded manually or fully automatically in textile machines.

With the foregoing and other objects in view, there is provided, in accordance with the invention, apparatus for taking up, holding ready and positioning of yarn packages in textile machines comprising spool holders radially disposed in stellar form and revolvable about horizontally mounted shafts, and respective arm means to which the spool holders are articulatingly secured and together with which form a positioning device. With such a construction of the spool holders, it is possible to obtain, with optimum utilization of space within a machine, the best-suited positions, respectively, for taking up, holding ready and unwinding of the yarn packages.

In accordance with another feature of the invention, the arm means, respectively, are circumferentially spaced a given distance from one another, and drive means are included for turning the positioning device through an angle corresponding to the spacing between adjacent spool holders. If especially large yarn packages, such as, for example, cross-wound coils or cheeses, which require a relatively long time to unwind, are to be presented to the work station of a textile machine, the circumferential spacing between the arms can be made so large that, during the unwinding of a cross-wound coil another arm is located in the yarn package take-up position and thereby holds ready a second coil as a reserve coil. Simultaneously, another arm with a spool holder can be in the throw-off position for an empty coil core. In such a case, three arms, mutually offset 120°, would suffice for a single unwinding device. The positioning device can, of course, also be equipped with a lesser or greater number of arms.

In order to guide the unwinding yarn of each yarn package reliably, in accordance with a further feature of the invention, a yarn-guiding member is coordinated with each arm.

Particularly advantageous and in accordance with yet another feature of the invention, the yarn guiding members are pivotally mounted, preferably on the positioning device.

In accordance with an added feature of the invention, the spool holders and the yarn-guiding members are movable relative to one another as the positioning device turns. It is consequently possible to obtain thereby, in addition to good accessibility of the individual yarn packages, also a particularly advantageous utilization of the available space within the machine. The yarn-guiding members and the spool holders can be swiveled or swung relative to one another in such a manner that, during the further shift of the positioning device through a single spacing between the spool holders, no hindrance for surrounding machine parts or the assembly area for the machine, is produced. Upon the completion of a shifting step, all of the swingable elements will have then assumed the position most favorable for the respective location. The yarn-guiding member and the spool holder, for example, will then be swung far apart in the take-up position so that even yarn packages of large dimensions can easily be mounted thereon. In the unwinding location, the spool holders and the yarn-guiding members can again be swung toward one another so that an optimum spacing from the yarn-guiding member to the unwinding coil results, which is of the greatest importance with respect to ballooning and unwinding tensions of the yarn. The spool holder can moreover, be oriented in such a manner that the unwinding yarn passes the succeeding deflection points, such as the yarn brake or cleaner and the like, with the smallest possible contact angle. Furthermore, the thread or yarn-guiding members moving in this manner, prevent mutual obstruction of all of the yarn starting ends located on the same positioning device, both during the movement thereof as well as when they are stationary.

In accordance with an additional feature of the invention, each yarn-guiding member is constructed as a hold-ready member for the yarn to be unwound. This can be achieved by providing in the immediate vicinity of the yarn-guiding member, which could be formed, for example, as a closed eye, an additional clamping point for a yarn starting end. Thereby, additional introducing or holding members, which would have to bring the yarn to the unwinding position thereof through especially controlled movements, become superfluous.

In accordance with another feature of the invention, in textile machines, particularly automatic winding machines wherein a multiplicity of work stations are provided side by side, which furthermore operate completely independently of one another, a separate turnable positioning device is coordinated with each work station.

Uninterrupted operation of each work station is attainable in accordance with a further feature of the invention, by the provision that, for releasing a turning motion of the positioning device, each of the work stations of the textile machine is coupled with the drive means for the positioning device. The work station of the machine, such as a winding apparatus, for example, can therefore couple the continuously revolving drive means for the positioning devices with the respective positioning device that is to be shifted further, by means of mechanical or electrical elements, when the supply coil is empty and can thereby make the next succeeding yarn package, which is in the held-ready position, swing into the unwinding position. The made-ready yarn starting end can subsequently be tied by conventional tying or knotting to the yarn starting end of the take-up coil, and the winding process can be continued.

The elements releasing a swinging motion of the positioning device can, however, also be controlled or shifted so that, in the event of a yarn break at the supply coil, only the broken yarn ends are tied together and no swinging motion of the positioning device is introduced.

In accordance with yet another feature of the invention, there are additionally provided manual means for releasing a stepwise turning motion of the positioning device. A possibility is provided thereby of shifting the positioning device in any manner desired whenever there is a change in the yarn lot, at the start of a work shift or on similar occasions.

Apparatus constructed according to the invention can be supplied with yarn packages manually as well as automatically. Similarly, the removal of empty coil cores remaining on the spool holders after the yarn packages have been unwound, may also be effected manually or automatically.

Other features which are considered as characteristic for the invention are set forth in the appended claims.

Although the invention is illustrated and described herein as embodied in apparatus for holding ready and positioning of yarn packages in textile machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings, in which.

Figure 1:
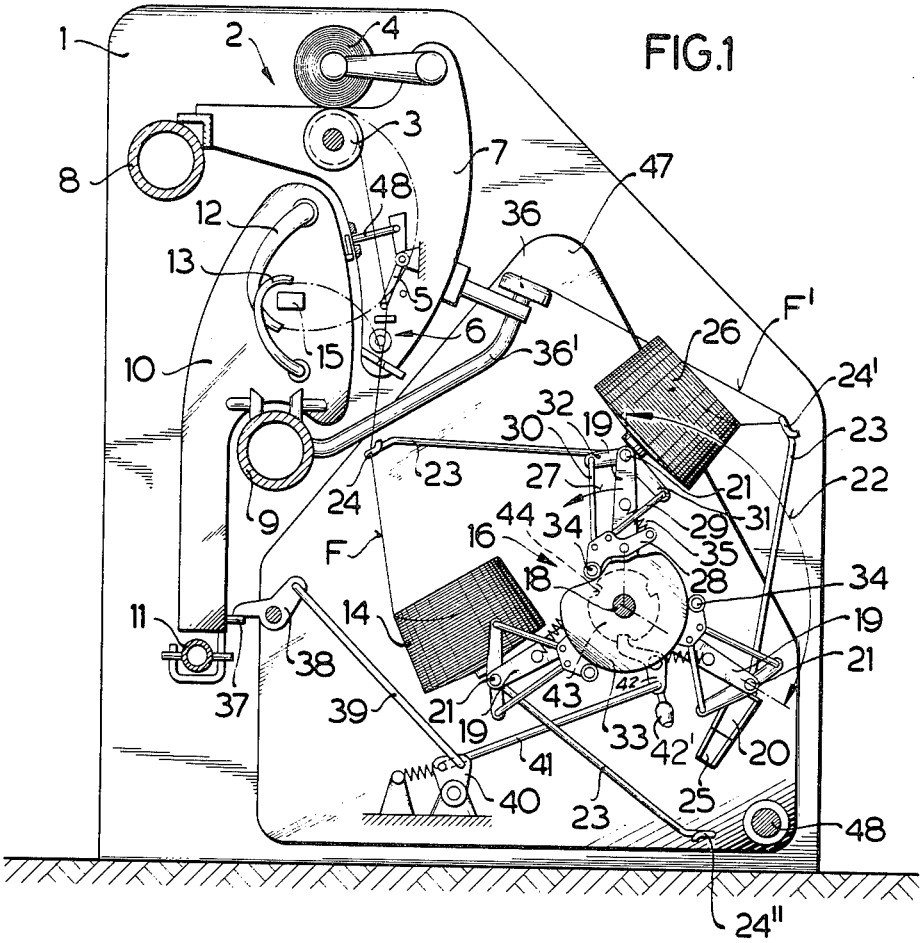
FIG. 1 is a diagrammatic side elevational view, partly in section, of an automatic winding machine with a positioning device constructed in accordance with the invention of the instant application.

Referring now to the drawings, and first, particularly to FIG. 1 thereof, there is shown therein an automatic cross-winding machine having a side wall 1 and a work station 2. In such machine, work stations of this type are disposed in a conventional manner in large numbers adjacent one another. Of the most important elements of the work station 2, there are shown a yarn-guiding drum 3, a take-up spool or coil 4, a yarn or thread regulator or monitor 5 and a yarn or thread brake 6. All of these elements are drivingly or rotatably mounted or rigidly secured at or in a housing 7, depending upon the function thereof. The housing 7 is secured on a supporting tube 8 which extends along the entire length of the machine. On an additional support tube 9, a housing 10 of a "traveling" knotting or tying device, which runs back and forth in a conventional manner on the support tube 9, is readily noted, the housing 10 being additionally braced on a guide tube 11. Only those parts of the "traveling" knotting or tying device that are necessary for understanding the principles of the invention, are shown in FIG. 1. They are a suction nozzle 12 for seizing and fetching a yarn end from the take-up spool 4, a gripping tube 13 for seizing and fetching the yarn starting end of a supply coil 14, as well as a thread or yarn tying device which may be formed of a conventional knotter 15.

Figure 2:
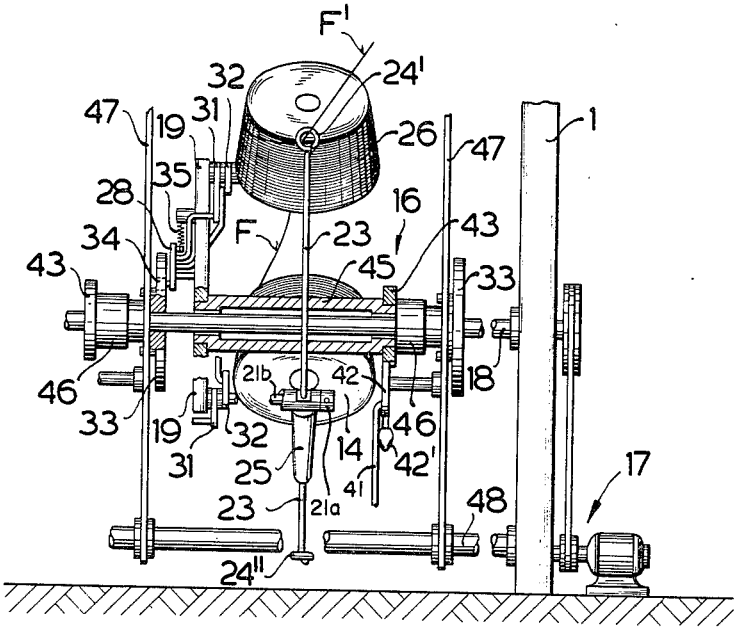
FIG. 2 is a diagrammatic front elevational view, partly in section, of the positioning device of FIG. 1.

The embodiment of the invention illustrated in and explained by means of FIGS. 1 and 2 includes a positioning device 16, in which especially large yarn packages are used as supply coils 14 and 26. Because of the long unwinding period for such supply coils, the feeding or supplying thereof to the positioning device by hand can still be entirely economical even for a large number of work positions. The removal of the empty cores 25 can also be performed manually. Of course, the supply coils can also be fed to the positioning device and mounted therein by means of conventional automatic loading or feeding equipment.

Figure 3:
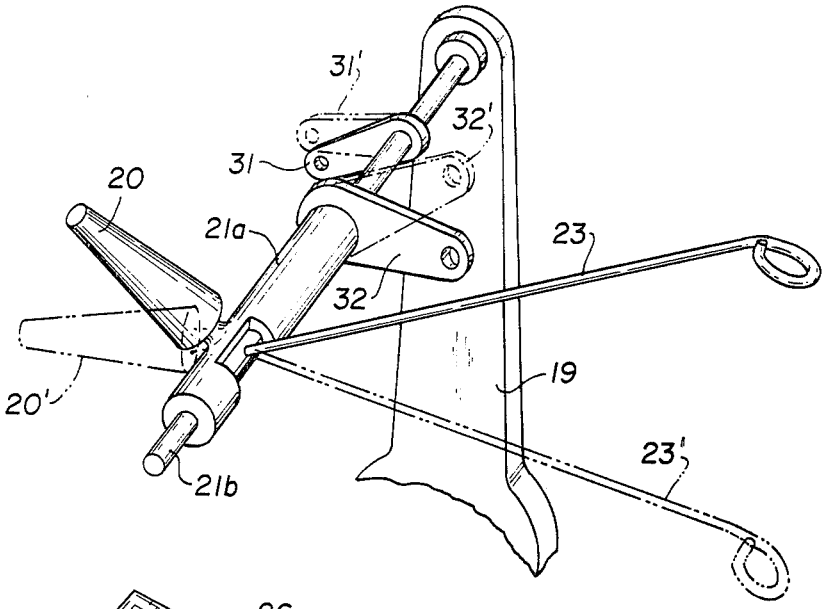
FIG. 3 is an enlarged perspective view of a detail of FIGS. 1 and 2, showing the disposition of some arms and levers of the positioning device.
Figure 4:
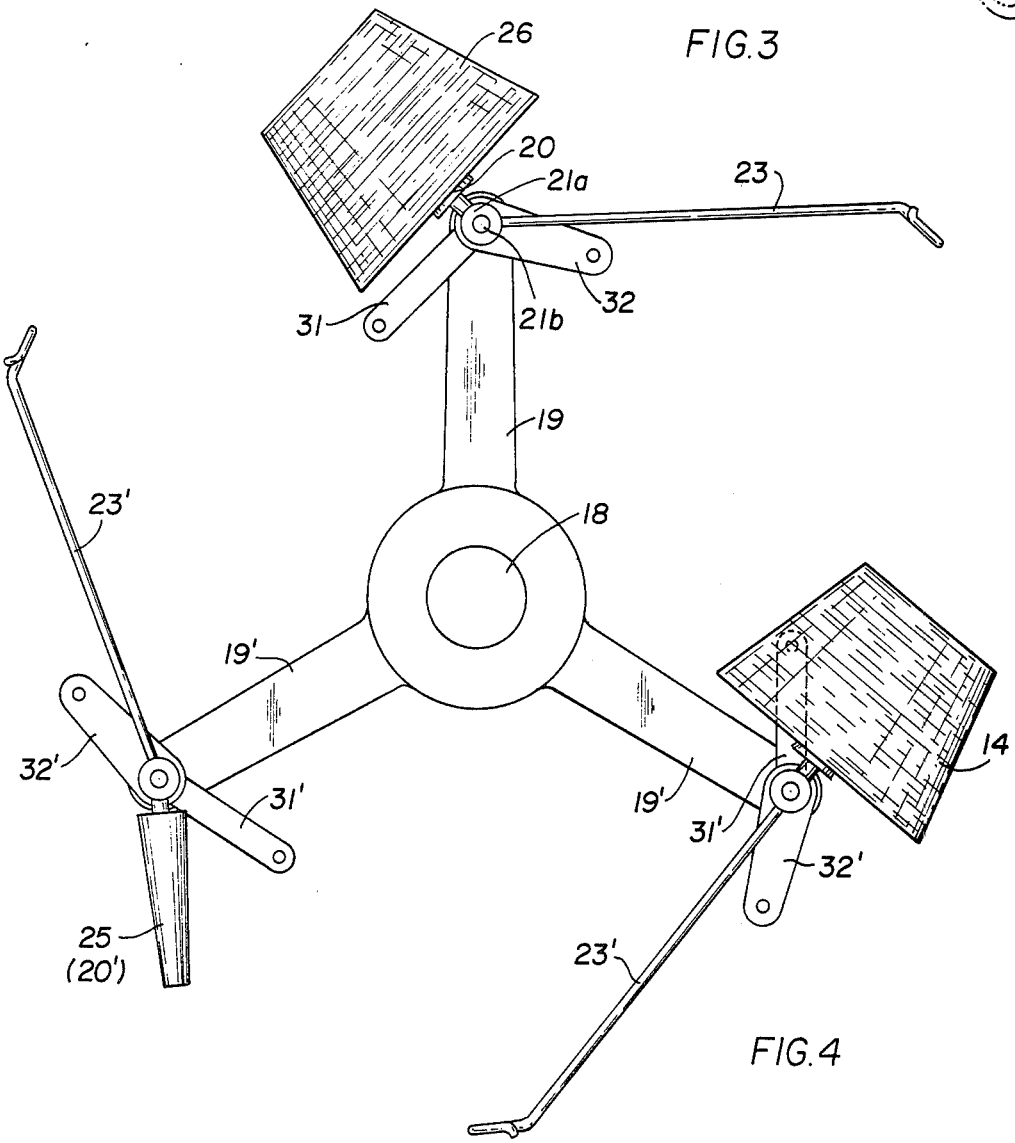
FIG. 4 is a more detailed and enlarged elevational view of the positioning device of FIG. 1, with some parts removed therefrom.

FIGS. 1 and 2 show the positioning device 16 in the unwinding position suited for the supply coil 14. Another supply coil 26 is in held-ready position, this latter position corresponding, in the illustrated embodiment, simultaneously to the take-up position for supply coils that are fed to the device by any desired method. Below the supply coil 26 there can be seen, in a further position, an empty core 25, which, in this position, can be removed and passed on, either manually or mechanically. The illustrated embodiment therefore relates to a positioning device 16 having three loading or insertion possibilities. Three arms 19 with equal spacing 22 from one another, are therefore disposed about a shaft 18, which extends along the long side of the machine. The shaft 18 is rotatably supported and is set in continuous rotation by means of a drive 17, as shown in FIG. 2. The spool holders 20 are pivoted at the pivots 21 on the arms 19. The yarn-guiding members 23 with guiding eyes 24 are also pivoted at the pivots 21. Turning of the yarn-guiding members 23 and the spool holders 20 relative to each other occurs as the positioning device 16 is advanced by one spacing 22 in the direction of the arrow 27, by means of cam levers 28 pivotally mounted at the arms 19, and which are, in turn, operatively connected through link rods 29 and 30 with levers 31 and 32. The swinging of the yarn-guiding members 23 and the spool holders 20 is controlled through a stationary cam 33, along the periphery of which, there move the cam levers 28, which are equipped with rollers 34 and are continuously in contact with the cam 33 under the biasing action of tension springs 35. As seen in the fragmentary perspective view of FIG. 3 and the elevational view of FIG. 4, the pivot 21 of each arm 19 of the positioning device 16 is formed of a rotatable outer hollow pivot shaft 21*a* and a coaxial and rotatable inner pivot shaft 21*b*. The lever 32, which is connected through the link rod 30 to the cam lever 28, as shown in FIG. 1, is securely mounted on the outer pivot shaft 21*a*, and the lever 31, which is connected through the link rod 29 to the cam lever 28, also shown in FIG. 1, is securely mounted on the inner pivot shaft 21*b*. The spool holder 20 extends radially from the outer hollow pivot shaft 21*a*, and the yarn-guiding member 23 is fixed to the inner pivot shaft 21*b* and extends radially therefrom through a suitable cut-out formed in the outer hollow pivot shaft 21*b*. The position of the positioning device 16 shown in FIG. 1, according to which the supply coil 14 is in the unwinding position, shows particularly clearly the different spacings of the guiding eyes 24, 24', 24'' relative to the supply coils 14 and 26 and to the empty core 25, respectively. The guiding eye 24 occupies the most favorable distance from the supply coil 14 with respect to ballooning of the yarn. It can, furthermore, be clearly seen that the thread or yarn F is tangent to the thread brake 6 and the thread regulator or monitor 5 at very small contact angles, so that the ideal case of an almost straight path for the thread from the guiding eye 24 to the thread guiding drum 3 is attained. The guiding eye 24' asociated with the supply coil 26 is, on the other hand, swung very close to the body of the coil. This position has a particularly advantageous effectt on the overall width and accessibility of the machine and even so offers the possibility of slipping or mounting supply coils therein without obstruction. With this position, furthermore, only a very short section of thread F' extends from the supply coil 26 to the guiding eye 24'. This signifies a reliable determination of the position of the thread and avoids a faulty transfer of the held-ready end of the thread upon further swinging of the spool holder into the unwinding position. The thread section F', in the illustrated embodiment, passes through the guiding eye 24', and is held firmly in a pivoted value 36 of a suction line 36'. The position of the guiding eye 24'' with respect to the empty core 25 shows that even in low-profile machines with little space available between the positioning device and assembly or mounting surface, sufficient freedom of motion can be obtained for the elements to be swung or swiveled.

The swinging motion of the positioning device 16 in direction of the arrow 27 is always initiated when a supply coil 14 has been completely unwound. In that case, there is no longer a thread in the thread brake 6 which could be seized by the gripping tube 13. The absence of a thread in the gripping tube 13 releases a pulse within the "traveling" tying or knotting device which lifts the pin 37 and swings a bell crank 38 clockwise, as shown in FIG. 1. By means of this swinging motion, a ratchet lever 42 which releases a locking disc 43 for rotation to the next stop position, is actuated through a rod 39, a pivoting strap 40 and a further rod 41. The aforementioned drive 17 for the swinging motion of the positioning device 16 is shown in FIG. 2. In FIG. 2, the continuously driven shaft 18 and a sleeve bushing 45 which is firmly connected to the arms 19, are clearly shown. After the ratchet lever 42 is disengaged, the sleeve bushing 45 is entrained through a conventional coupling element 46, shown here in a simplified manner, until the ratchet lever 42 has snapped in at the next successive stop 44. It is further noted from FIG. 2 that additional positioning devices 16 can be disposed side by side, corresponding to the number of work stations 2. Partitions 47 are disposed in accordance with the spacing between one work station and the next work station, are secured by means of the continuous rod 48, and prevent mutual obstruction of supply coils unwinding side by side.

If a yarn F breaks during the unwinding of a supply coil 14, it is advantageous to remove the yarn break instead of initiating a swinging motion of the positioning device and bringing a new spool into the unwinding position. As it is well-known that yarn breaks occur almost exclusively in the immediate vicinity of the yarn breaking devices, the traveling tying or knotting device is brought to a stop in such a case by means of the yarn regulator or monitor 5 through a detent pin 48, and a knotting operation is initiated, as it is known from automatic winding machines. To this end, the pivoted gripping tube 13 seizes the yarn end located in the yarn brake 6, and the suction nozzle 12 seizes the yarn end of the take-up coil 4. Both yarn ends are presented to the tying or knotting device 13 and tied together in conventional manner. The take-up or winding operation can then be continued, and the yarn is drawn from the supply coil 14 until the next yarn break occurs or until it is completely unwound.

A positioning device according to the embodiment shown in the drawing can, of course, also be used in a simple manually operated winding machine. In such a case, the swinging motion of the positioning device 16 can be released in a simple manner also by hand. To this end, the ratchet lever 42 is merely connected with a disengagement shaft, not shown in the drawing, which is located at the machine in a position in which it is conveniently able to be grasped. The same manual actuation, however, can also be additionally provided in the automatic machine embodiment, shown in the drawing.

We claim:

1. In a textile machine having at least one work station, an apparatus for holding ready and positioning yarn packages to be unwound at the work station, the apparatus comprising rotatable shaft means, a plurality of arm means radially extending from said shaft means and circumferentially disposed at a given angle from one another, horizontally extending pivot means mounted on each of said arm means, a spool holder radially extending from each of said pivot means, said spool holder and said pivot means together with said plurality of arm means on which said pivot means are mounted, forming a positioning device, the plurality of spool holders at the work station being jointly revolvable with the plurality of arm means about said shaft means.

2. Apparatus according to claim 1 including a yarn-guiding member connected to each of said arm means.

3. Apparatus according to claim 2 wherein said yarn-guiding members are pivotally mounted.

4. Apparatus according to claim 2 wherein each of said pivot means area hollow, and further comprises a pivot shaft rotatably disposed within each of said hollow pivot means, said spool holders and said yarn-guiding members being secured, respectively, to said hollow pivot means and said pivot shafts and being movable relative to one another as said positioning device turns.

5. An apparatus according to claim 1 further including manual means for producing a stepwise turning motion of said positioning device.

6. Apparatus according to claim 1 including drive means for turning said positioning device through an angle corresponding to the given angle at which said plurality of arm means are disposed circumferentially from one another about said shaft means.

7. Apparatus according to claim 6 wherein said drive means is couplable with the respective work station for producing said turning of said positioning device.

8. In a textile machine having a plurality of work stations, an apparatus located at each of the work stations for holding ready and positioning yarn packages to be unwound at the respective work stations, each apparatus comprising rotatable shaft means, a plurality of arm means radially extending from said shaft means, and circumferentially disposed at a given angle from one another, horizontally extending pivot means mounted on each of said arm means, a spool holder radially extending from each of said pivot means, said spool holder and said pivot means together with said plurality of arm means on which said pivot means are mounted, forming a positioning device, the plurality of spool holders at each of the work stations being jointly revolvable with the respective plurality of arm means about the respective shaft means, and drive means at each of the work stations for turning the respective positioning device through an angle corresponding to the given angle at which the respective plurality of arm means are disposed circumferentially from one another about the respective shaft means.

* * * * *